US007311370B2

(12) United States Patent
Kondoh

(10) Patent No.: US 7,311,370 B2
(45) Date of Patent: Dec. 25, 2007

(54) INKJET RECORDING HEAD DRIVING CIRCUIT, INKJET RECORDING HEAD, AND INKJET PRINTER

(75) Inventor: Yoshinao Kondoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 297 days.

(21) Appl. No.: 10/968,269

(22) Filed: Oct. 20, 2004

(65) Prior Publication Data

US 2005/0116883 A1 Jun. 2, 2005

(30) Foreign Application Priority Data

Dec. 1, 2003 (JP) ..... 2003-401337

(51) Int. Cl.
*B41J 29/38* (2006.01)
*B41J 2/205* (2006.01)

(52) U.S. Cl. ..... 347/10; 347/15

(58) Field of Classification Search ..... 347/11
See application file for complete search history.

(56) References Cited

U.S. PATENT DOCUMENTS 6,276,773 B1 8/2001 Takizawa ..... 347/10
6,283,568 B1 * 9/2001 Horii et al. ..... 347/10
6,371,587 B1 * 4/2002 Chang ..... 347/11
6,454,377 B1 * 9/2002 Ishizaki ..... 347/15
6,663,208 B2 * 12/2003 Suzuki et al. ..... 347/10
7,084,996 B2 * 8/2006 Kubo ..... 358/1.15

FOREIGN PATENT DOCUMENTS

JP A-2001-179964 7/2001

* cited by examiner

*Primary Examiner*—Matthew Luu
*Assistant Examiner*—Shelby Fidler
(74) *Attorney, Agent, or Firm*—Morgan, Lewis & Bockius LLP

(57) ABSTRACT

Provided is a driving circuit for an inkjet recording head, the inkjet recording head having plural pressure generation chambers filled with ink, a nozzle, and a vibration generation section which causes a pressure change in each pressure generation chamber. The driving circuit includes: a driving waveform generation section including first and second waveform generation sections that generate respectively different driving waveforms during one driving cycle on the basis of sizes of ink droplets; a control section that outputs a waveform select signal; and a driving waveform supply section that supplies a driving waveform selected based on the waveform select signal to the vibration generation section. When the selected driving waveform is generated by the first waveform generation section, the driving waveform is selected during each of periods into which the driving cycle is divided, and is supplied to the vibration generation section.

15 Claims, 13 Drawing Sheets

INKJET RECORDING HEAD DRIVING CIRCUIT, INKJET RECORDING HEAD, AND INKJET PRINTER

CROSS-REFERENCE TO RELATED APPLICATION

This application claims priority under 35 USC 119 from Japanese Patent Application No. 2003-401337, the disclosure of which is incorporated by reference herein.

BACKGROUND OF THE INVENTION

1. Field of the Invention

The present invention relates to an inkjet recording head driving circuit, an inkjet recording head, and an inkjet printer. More specifically, the invention relates to an inkjet recording head driving circuit, an inkjet recording head, and an inkjet printer for changing, by means of an actuator such as a piezoelectric vibrator, a volume of a pressure generation chamber filled with an ink, discharging by means of this voltage change fine ink droplets from a nozzle linked to the pressure generation chamber, and recording a character, a graphic, or the like on a recording medium.

2. Description of the Related Art

An inkjet printer is conventionally known that includes an inkjet recording head that, by using an actuator such as a piezoelectric vibrator, changes (expands or contracts) a volume of a pressure generation chamber filled with an ink, and that, as a result of an internal pressure change within the pressure generation chamber, discharges ink droplets from the tip of a nozzle formed to communicate with the pressure generation chamber.

A technique related to a driving circuit that drives such an inkjet recording head is disclosed in, for example, Japanese Patent Application Laid-Open (JP-A) No. 2001-179964, a technique for dividing a driving cycle into two cycles, and for supplying to the actuator in time sequence a first driving voltage waveform for discharging ink droplets, and a second driving voltage waveform that while avoiding discharging ink droplets prevents the kind of nozzle clogging which is caused by increase in ink viscosity.

Further, a technique is disclosed in Japanese Patent Application Laid-Open (JP-A) No. 2001-26102 (U.S. Pat. No. 6,276,773) for providing plural waveform generation circuits that output plural types of driving voltage waveforms within one printing cycle, for selecting a driving voltage waveform from among various types of driving voltage waveforms according to waveform select data based on gradation data, for supplying the selected driving voltage waveform to the actuator, and for thereby acquiring plural gradations within one driving cycle.

The technique disclosed in JP-A No. 2001-179964 has, however, encountered the following difficulties. It is necessary to transfer print data twice, within one driving cycle, to a section that on the basis of the print data selects one out of the first driving voltage waveform and the second driving voltage waveform, and that supplies to the actuator the driving voltage waveform selected. Such a procedure causes redundant print data, and complicates image processing control. In addition, in order to acquire plural gradations within one driving cycle, it is necessary to supply the actuator with the first driving voltage waveform multiple times within one driving cycle. JP-A No. 2001-179964 describes a configuration in which an inversion circuit is provided that inverts print data at predetermined timings within one driving cycle, thereby making it sufficient to transfer the data only once within one driving cycle. However, one out of the first driving voltage waveform for discharging ink droplets and the second driving voltage waveform for providing meniscus vibration without discharging ink droplets, is invariably selected. Because of this, in the case of a configuration in which plural gradations are acquired, by providing a waveform generation circuit that outputs plural driving voltage waveforms within one driving cycle, and a waveform generation circuit that outputs only one driving voltage waveform within one driving cycle, the technique disclosed in JP-A No. 2001-179964 cannot be applied.

The technique disclosed in JP-A No. 2001-26102 has encountered the following difficulties. It is necessary to transfer waveform select data twice, within one driving cycle, to a switching section that selects one of plural driving voltage waveforms according to waveform select data based on gradation data, and that supplies to the actuator the voltage waveform selected.

SUMMARY OF THE INVENTION

The present invention has been achieved in view of the above circumstances and provides an inkjet printer driving circuit, an inkjet recording head, and an inkjet printer with the capability to transfer waveform select data based on gradation data only once within one driving cycle, in a configuration in which plural gradations are acquired, by providing a waveform generation circuit that outputs plural driving voltage waveforms within one driving cycle and a waveform generation circuit that outputs only one driving voltage waveform within the one driving cycle.

According to a first aspect of the invention, a driving circuit for an inkjet recording head is provided, the inkjet recording head having: plural pressure generation chambers filled with an ink; a nozzle which is provided in each of the pressure generation chambers, and from which the ink is discharged; and a vibration generation section which is provided to relate to each of the pressure generation chambers, and which causes a pressure change in each of the pressure generation chambers. The driving circuit has: a driving waveform generation section including a first waveform generation section that, during each of plural periods into which a driving cycle is divided, generates at least two driving waveforms from among plural driving waveforms according to sizes of droplets of the ink, and a second waveform generation section that generates within the one driving cycle a driving waveform which is different from the driving waveforms generated by the first waveform generation section; a control section that, during each driving cycle, outputs, on the basis of print data, a waveform select signal for selecting from among the plural driving waveforms one driving waveform to be supplied to the vibration generation section; and a driving waveform supply section that supplies to the vibration generation section a driving waveform selected on the basis of the waveform select signal, from among the plural driving waveforms output by the driving waveform generation section, and that, when a driving waveform selected is one of the driving waveforms generated by the first waveform generation section, during each divided period selects a driving waveform and supplies the driving waveform selected to the vibration generation section.

According to the first aspect of the invention, the driving waveform generation section includes a first waveform generation section that, according to sizes of droplets of the ink, i.e., according to gradations within each of plural periods into which driving cycle is divided, generates at least two driving waveforms among plural driving waveforms. Namely, the first waveform generation section generates different types of driving waveforms in time sequence within one driving cycle. Within the one driving cycle the second waveform generation section generates a driving waveform which is different from the driving waveforms generated by the first waveform generation section. In other words, the number of waveform generation sections is smaller than the number of types of driving waveforms.

During each driving cycle, the control section outputs on the basis of print data a waveform select signal for selecting one driving waveform, from among the plural driving waveforms, to be supplied to the vibration generation section. Namely, even when a driving waveform is output by the first waveform generation section that within one driving cycle outputs to the vibration generation section plural driving waveforms, the control section does not output a waveform select signal during each divided period but rather outputs a waveform select signal only once during each driving cycle.

Based on the waveform select signal output by the control section, the driving waveform supply section supplies to the vibration generation section a driving waveform selected from among the multiple driving waveforms output by the driving waveform generation section. When a driving waveform selected is one of the driving waveforms generated by the first waveform generation section, the driving waveform supply section supplies the driving waveform selected to the vibration generation section during the divided period within which the driving waveform is generated, but does not output the other driving waveforms during the other divided periods. If the selected driving waveform is a driving waveform generated by the second waveform generation section, the driving waveform supply section supplies the driving waveform selected within the one driving cycle.

Thus, the control section exclusively selects one of plural driving waveforms generated by the first waveform generation section, and the driving waveform supply section supplies to the vibration generation section the driving waveform selected. Therefore, the present invention produces the superior effects described below. Even in a configuration in which plural gradations are acquired, by means of a configuration combining a first waveform generation section that generates plural driving voltage waveforms within one driving cycle and a second waveform generation section that generates only one driving voltage waveform within one driving cycle, it is sufficient to transfer the waveform select signal from the control section to the driving waveform supply section only once within each driving cycle.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be described hereinafter in detail with reference to the drawings.

Figure 1:
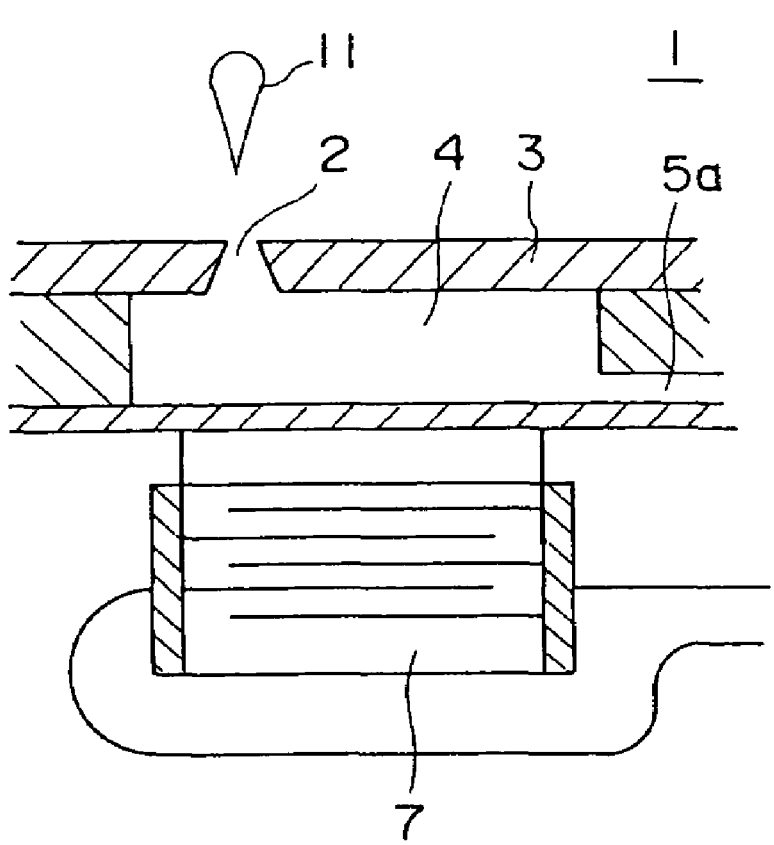
FIG. 1 is a schematic cross-sectional view of an inkjet recording head.
Figure 2:
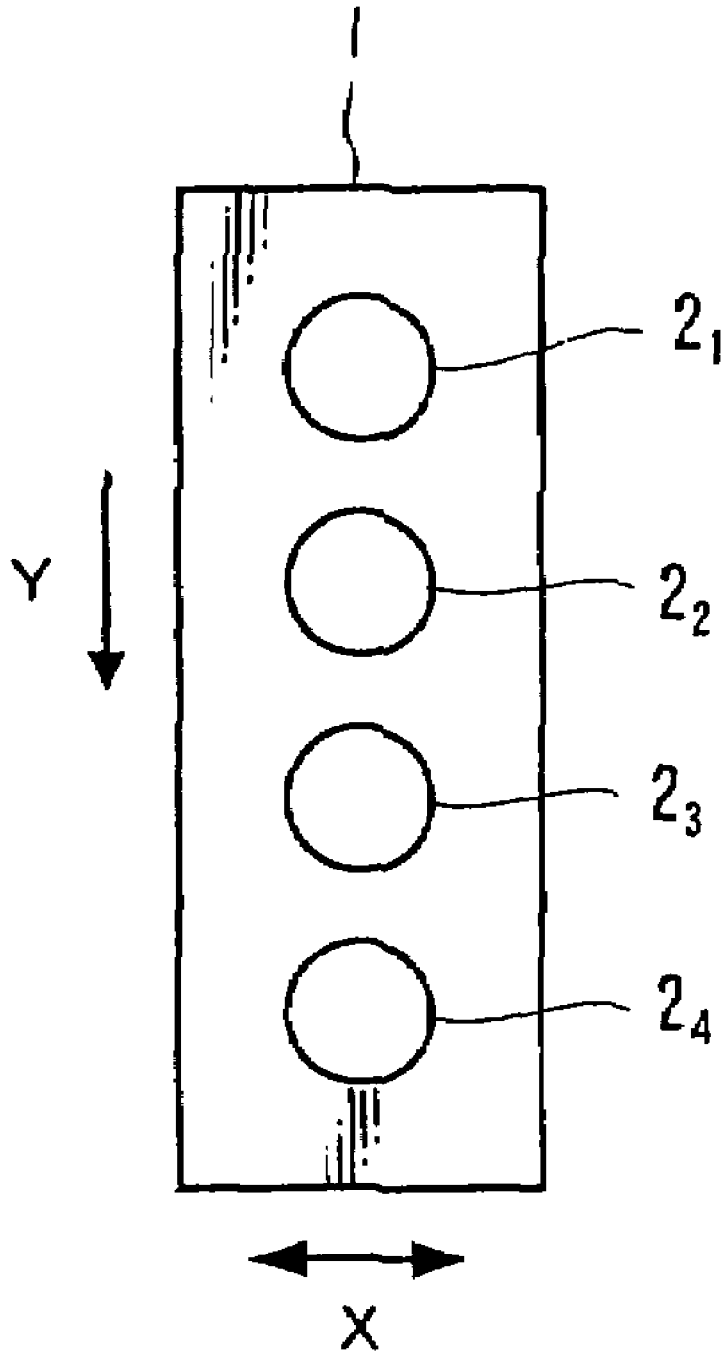
FIG. 2 is a schematic plan view of the inkjet recording head.
Figure 3:
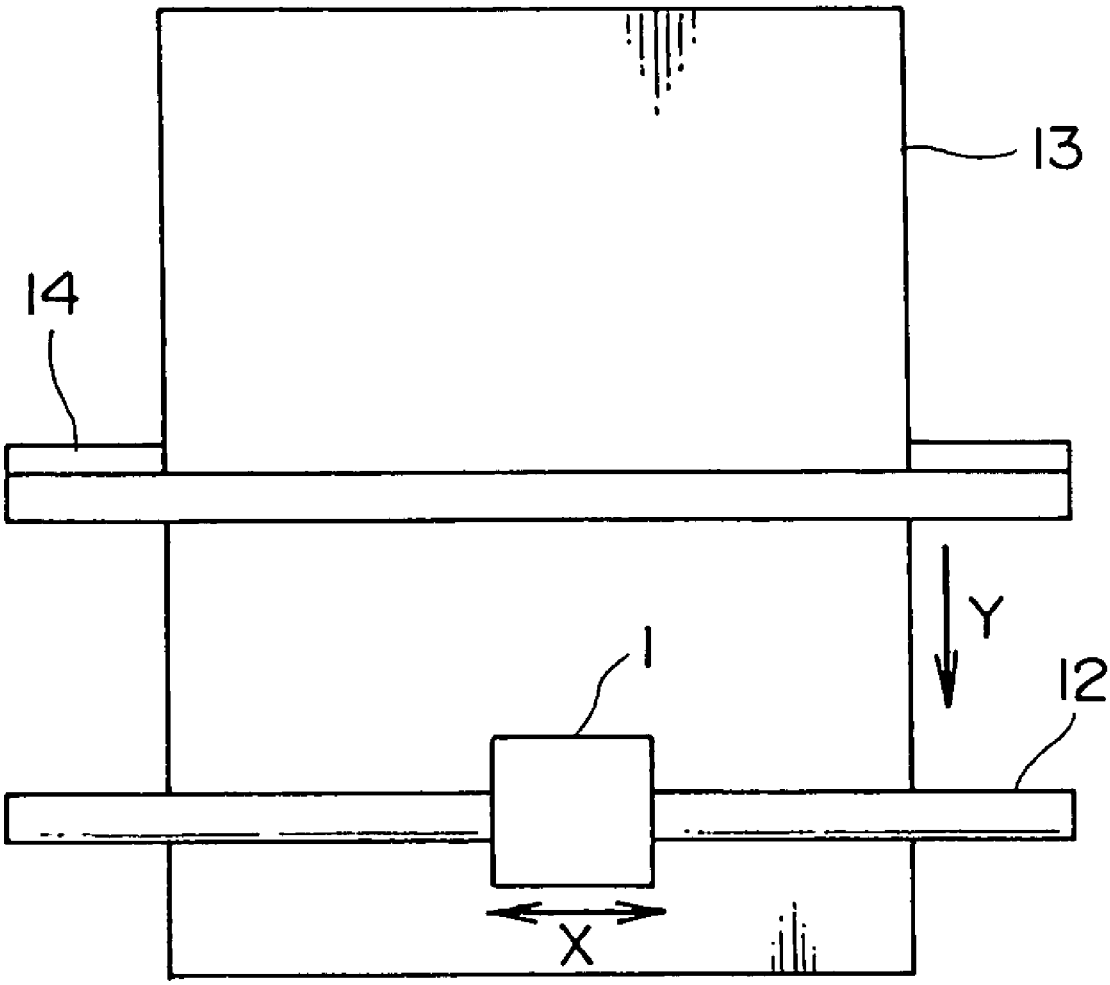
FIG. 3 is a schematic plan view showing a positional relationship between a recording medium and the inkjet recording head.

FIG. 1 is a schematic cross-sectional view of an inkjet recording head 1 according to a first embodiment of the invention. FIG. 2 is a schematic plan view of the inkjet recording head 1. FIG. 3 is a schematic plan view showing a positional relationship between a recording medium and the inkjet recording head 1 in an inkjet printer.

As shown in FIG. 1, the inkjet recording head 1 is roughly composed of a nozzle plate 3 having plural nozzles (orifices) 2 formed therein; a pressure generation chamber 4 provided to relate to each nozzle 2 and filled with an ink 11 discharged from a corresponding nozzle 2; an ink supply path 5*a* for supplying from an ink tank, not shown, the ink 11 to the pressure generation chambers 4; and an actuator 7 provided to relate to each pressure generation chamber 4.

By driving the actuator 7, the pressure generation chamber 4 either expands or contracts, and as a result of this voltage change ink contained in the pressure generation chamber 4 is discharged from the nozzle 2. The actuator 7 is constituted by, for example, a piezoelectric vibrator.

In this embodiment, as shown in FIG. 2, a configuration will be described of an inkjet recording head 1 in which four nozzles $\mathbf{2}_1$, $\mathbf{2}_2$, $\mathbf{2}_3$, and $\mathbf{2}_4$ are provided equidistantly in a sub-scan direction (a Y axis direction). The number of nozzles 2 is not limited to four but may be three or less, or five or more. A pitch of the nozzles $\mathbf{2}_1$, $\mathbf{2}_2$, $\mathbf{2}_3$, and $\mathbf{2}_4$ is not limited to an equidistant pitch, but can be set arbitrarily.

As shown in FIG. 3, the inkjet recording head 1 is moved along a guide 12 provided on a main body of an inkjet printer, not shown, in a main scan direction (an X axis direction). In addition, while feeding by means of a feed roller 14 a recording medium (recording paper) 13 in a sub-scan direction (Y axis direction) orthogonal to the main scan direction, the inkjet recording head 1 forms many dots on the recording medium 13, thereby performing a printing operation. In this case, the nozzle 2 passes through an arbitrary position on the recording medium 13 only once.

The inkjet recording head 1 may be moved while the recording medium 13 is kept in a fixed position, or the recording medium 13 may be moved while the inkjet recording head 1 is maintained in a fixed position. The recording medium 13 may be arranged horizontally, but the recording medium 13 is not limited to any one specific arrangement as long as the inkjet recording head 1 can be scanned relatively to the recording medium 13 along a surface of the recording medium 13.

Arrangements may be made for ink droplets to be discharged from the nozzles $2_1$, $2_2$, $2_3$, and $2_4$ only when the inkjet recording head 1 is moved rightward from the left initial position in FIG. 3. On the other hand, arrangements may be made for ink droplets to be discharged from the nozzles $2_1$, $2_2$, $2_3$, and $2_4$ only when the inkjet recording head 1 is moved in the opposite direction, that is, moved leftward from the right initial position shown in FIG. 3. Such arrangements ensure that, when the initial position of the inkjet recording head 1 is located on the right, the recording head 1 can promptly start recording, and this brings with it the merit that it becomes possible to perform gradation recording at a higher speed.

Figure 4:
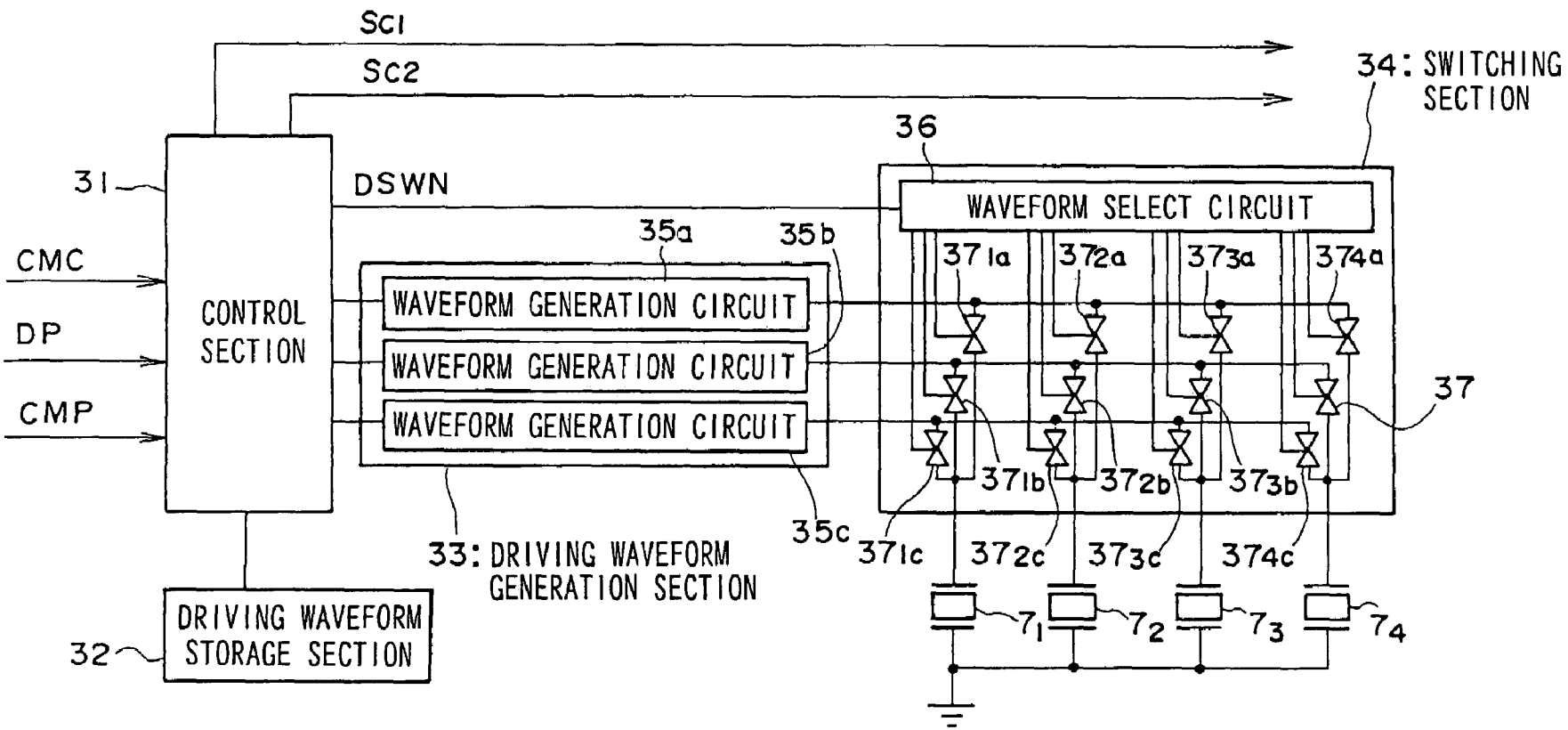
FIG. 4 is a block diagram of a configuration of a driving circuit for the inkjet recording head.

FIG. 4 is a block diagram of a configuration of a driving device 10 for the inkjet recording head 1 according to the present embodiment.

As shown in FIG. 4, the driving device 10 for the inkjet recording head 1 includes a driving waveform generation section 33 that generates plural driving voltage waveforms, a driving waveform storage section 32 that stores in advance information on the voltage waveforms to be generated by the driving waveform generation section 33, a switching section 34 that switches the driving voltage waveforms supplied to actuators $7_1$, $7_2$, $7_3$, $7_4$ relating to nozzles $2_1$, $2_2$, $2_3$, $2_4$, respectively, and a control section 31 that controls both the driving the signal reception and transmission of the respective constituent elements.

The driving waveform generation section 33 includes three waveform generation circuits 35*a*, 35*b*, and 35*c* for generating multiple types (five in this embodiment) of driving voltage waveforms. A power amplification section, not shown, is connected to each of the waveform generation circuits 35*a*, 35*b*, and 35*c*. Based on a driving voltage waveform signal generated by the waveform generation circuits 35*a*, 35*b*, and 35*c*, the power amplification section either raises or reduces the voltage applied and supplies a driving voltage to the switching section 34. The waveform generation circuits 35*a*, 35*b*, and 35*c* generate driving voltage waveforms based on patterns stored in advance in a driving waveform storage section 32 which will be described later.

The driving waveform storage section 32 is composed of a storage device such as a read only memory (ROM), a random access memory (RAM), a flexible disk (FD), or a hard disk (HDD). Based on various print settings, the driving waveform storage section 32 stores information for generating driving voltage waveforms formed in advance. This information is read by the control section 3 1, which will be described later, and is then fed to the driving waveform generation section 33.

Each of the waveform generation circuits 35*a*, 35*b*, and 35*c* is connected by signal lines to actuators $7_1$, $7_2$, $7_3$, $7_4$ respectively related to nozzles $2_1$, $2_2$, $2_3$, $2_4$. To supply to the actuators $7_1$, $7_2$, $7_3$, $7_4$ one from among the different driving voltage waveforms generated by the waveform generation circuits 35*a*, 35*b*, and 35*c*, a total of twelve switches $37_{1a}$. . . to $37_{4c}$, are provided in the switching section 34 between the signal lines and the actuators $7_1$, $7_2$, $7_3$, $7_4$.

In order to drive arbitrary actuators (e.g., actuators $7_2$ and $7_3$) among the actuators $7_1$, $7_2$, $7_3$, $7_4$ by means of the driving voltage waveform generated by the waveform generation circuit 35*b*, for example, switches $37_{2b}$ and $37_{3b}$ may be turned on and the remaining switches $37_{1a}$ to $37_{4c}$ may be turned off. ON and OFF switching of switches $37_{1a}$ to $37_{4c}$, is effected by a waveform select circuit 36 on the basis of an indication signal DSWN from the control section 31.

It should be noted that the actuator 7 corresponds to a vibration generation section according to the invention, that the waveform generation circuit 35*a* corresponds to a first waveform generation section according to the invention, and that the waveform generation circuits 35*b* and 35*c* correspond to a second waveform generation circuit according to the invention. In addition, the control section 31 corresponds to a control section according to the invention, and the switching section 34 corresponds to a driving waveform supply section according to the invention.

Figures 5A, 5B, 5C:
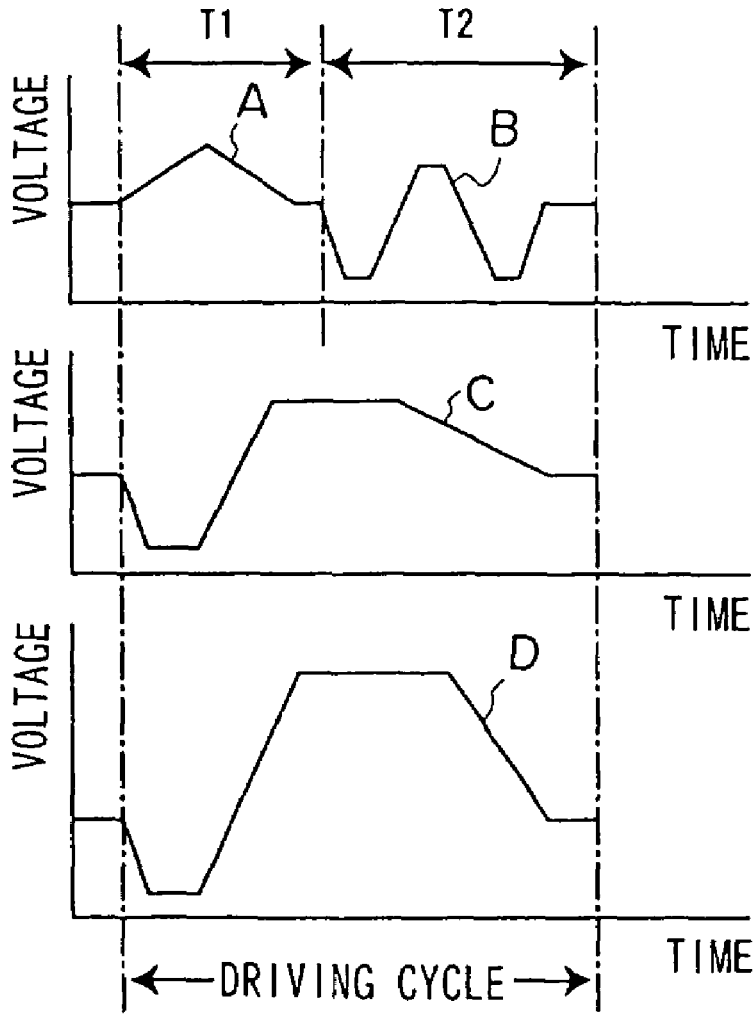
FIGS. 5A to 5C are waveform views showing driving voltage waveforms generated by respective waveform generation circuits.

FIGS. 5A to 5C respectively depict each one example of driving voltage waveforms output by the waveform generation circuits 35*a*, 35*b*, and 35*c*. As shown in FIG. 5A, a driving cycle T is divided into periods T1 and T2, and the waveform generation circuit 35*a* outputs a driving voltage waveform A during period T1, and a driving voltage waveform B during period T2. As shown in FIG. 5B, the waveform generation circuit 35*b* outputs a driving voltage waveform C within the driving cycle T, and as shown in FIG. 5C, the waveform generation circuit 35*c* outputs a driving voltage waveform D within the one driving cycle.

In this embodiment, by applying a micro-vibration to a meniscus of the actuator 7, the driving voltage waveform A serves as a waveform for preventing ink from clogging inside the nozzles. At this time, ink is not discharged from nozzle 2. The driving voltage waveform B serves as a waveform for discharging ink droplets for small dots, the driving voltage waveform C serves as a waveform for discharging ink droplets for medium dots, and the driving voltage waveform D serves as a waveform for discharging ink droplets for large dots. Accordingly, the driving voltage waveforms A, B, C, and D can be referred to as waveforms that correspond to gradations "0", "1", "2", and "3", respectively. In this embodiment, the driving voltage waveform A serves as the waveform for applying a micro-vibration to the meniscus of the actuator 7, but alternatively, this waveform may serve for not applying any voltage at all, or for discharging ink droplets.

The driving cycle T can, for example, be set on the basis of a time required to output the driving voltage waveform for discharging an ink droplet having the largest diameter.

Figure 6:
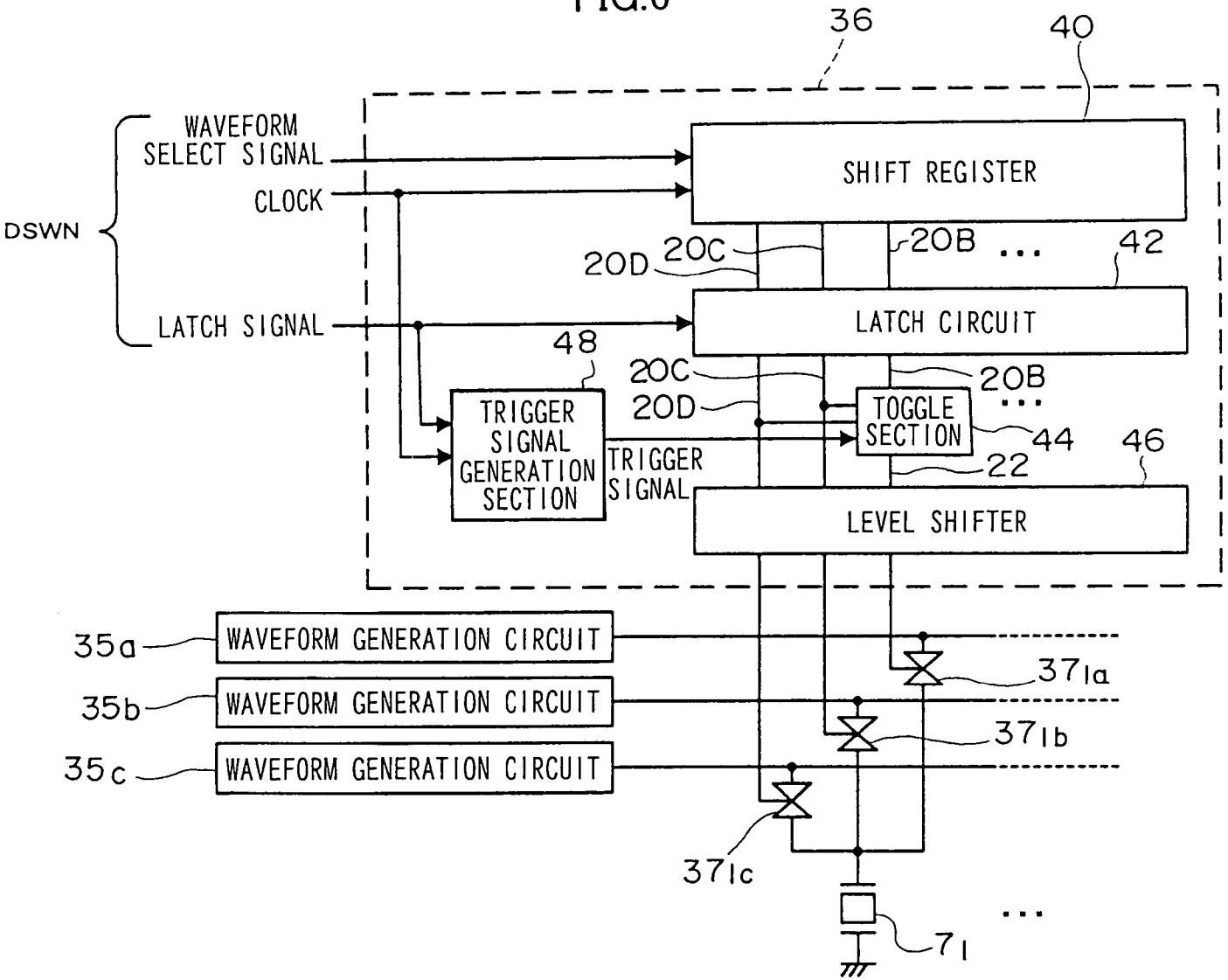
FIG. 6 is a block diagram showing a configuration of a waveform select circuit.

FIG. 6 is a block diagram of the waveform select circuit 36.

As shown in FIG. 6, the waveform select circuit 36 is constituted by a shift register 40, a latch circuit 42, a toggle section 44, a level shifter 46, and a trigger signal generation section 48.

As shown in FIG. 6, the indication signal DSWN is constituted to include a waveform select signal (waveform select data), a clock signal, and a latch signal.

A waveform select signal and a clock signal are input into the shift register 40, whereas a latch signal is input into the latch circuit 42. A clock signal and a latch signal are also input into the trigger signal generation section 48.

A waveform select signal is a signal for selecting the driving voltage waveform to be supplied to the actuator 7, and is a serial signal composed of a driving waveform B select signal 20B, a driving waveform C select signal 20C, and a driving waveform D select signal 20D. Each of the driving waveform B select signal 20B, the driving waveform C select signal 20C, and the driving waveform D select signal 20D is one-bit data that is represented by "0" or "1". The driving waveform B select signal 20B becomes "0" when the driving voltage waveform A is selected, and becomes "1" when the driving voltage waveform B is selected. In other words, the driving waveform B select signal 20B is a signal for selecting the driving voltage waveform A or B. Further, the driving waveform C select signal 20C becomes "1" when the driving voltage waveform C is selected, and becomes "0" when the driving voltage waveform C is not selected. The driving waveform D select signal 20D becomes "1" when the driving voltage waveform D is selected, and becomes "0" when the driving voltage waveform D is not selected.

In other words, the waveform select signal becomes a three-bit serial data "000" when the driving voltage waveform A is selected, a three-bit serial data "100" when the driving voltage waveform B is selected, a three-bit serial data "010" when the driving voltage waveform C is selected, and a three-bit serial data "001" when the driving voltage waveform D is selected. Such waveform select signals are continuously input into the shift register 40 in accordance with the number of actuators 7.

An instance of supplying a driving voltage waveform to one actuator $\mathbf{7}_1$ will be described hereinafter. Since in terms of supplying a driving voltage waveform, the other actuators are the same as actuator $\mathbf{7}_1$, instances of the other actuators will not be described.

The shift register 40 converts into three-bit parallel data a waveform select signal that has been input as three-bit serial data, and outputs the three-bit parallel data to the latch circuit 42.

By inputting a latch signal, the latch circuit 42 latches (holds therein) the parallel data output by the shift register 40.

A trigger signal generated by the trigger signal generation section 48, as well a driving waveform B select signal 20B, a driving waveform C select signal 20C, and a driving waveform D select signal 20D, all from the latch circuit 42, are input into the toggle section 44, and on the basis of these signals the toggle section 44 outputs an inverted signal 22.

The trigger signal generation section 48 generates a trigger signal based on the clock signal and the latch signal input, and outputs to the toggle section 44 the trigger signal generated.

Figure 7:
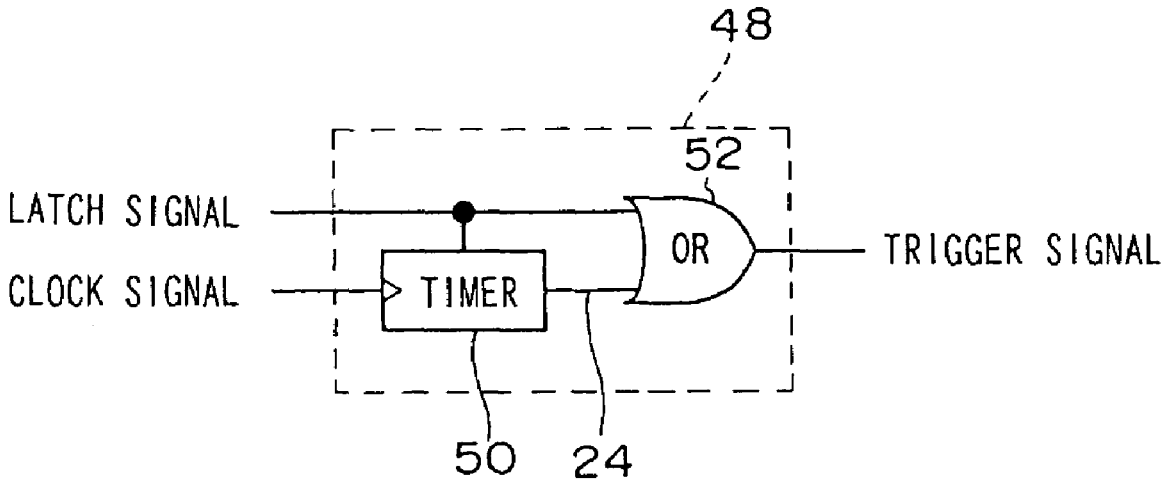
FIG. 7 is a block diagram showing a configuration of a trigger signal generation section.

As shown in FIG. 7, for example, the trigger signal generation section 48 is constituted by a timer 50 and an OR circuit 52.

A clock signal and a latch signal are input into the timer 50. The timer 50 generates a delay signal 24 on the basis of these signals, and outputs the delay signal 24 to the OR circuit 52. When a latch signal is input into the timer 50, the timer 50 starts counting the clock signal. When the number of clocks reaches a preset count value, the timer 50 outputs the delay signal 24 to the OR circuit 52. The count value is set at a value corresponding to period T1 shown in FIG. 5A.

The OR circuit 52 performs an OR operation between the latch signal and the delay signal 24, and outputs to the toggle section 44 as a trigger signal the OR operation result. In other words, whenever a latch signal or a delay signal 24 is input into the OR circuit 52, the OR circuit 52 outputs the trigger signal to the toggle section 44. Accordingly, the trigger signal is output to the toggle section 44 during each driving cycle, and whenever a period T1 has expired.

Figure 10:
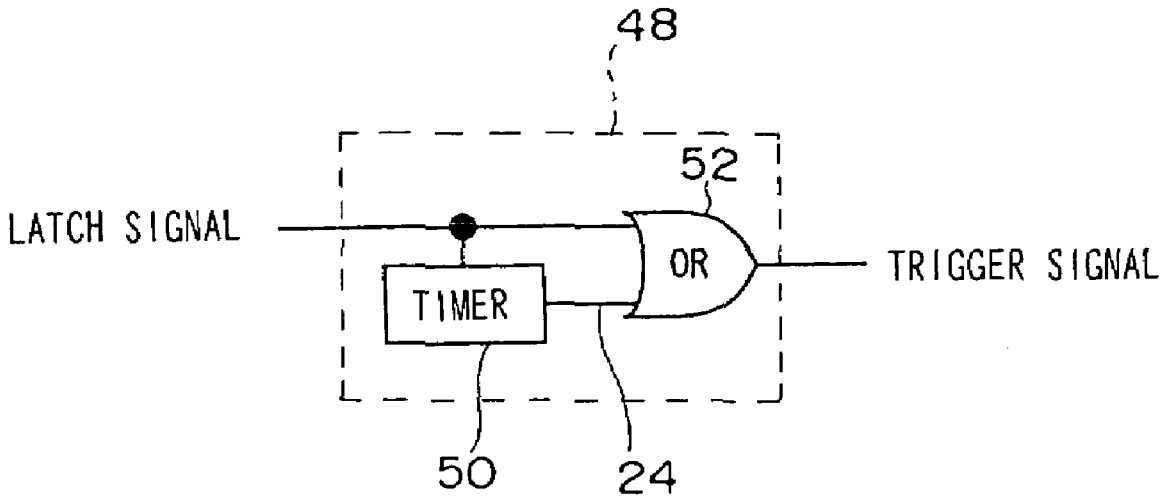
FIG. 10 is a block diagram showing another example of the configuration of the trigger signal generation section.
Figure 11:
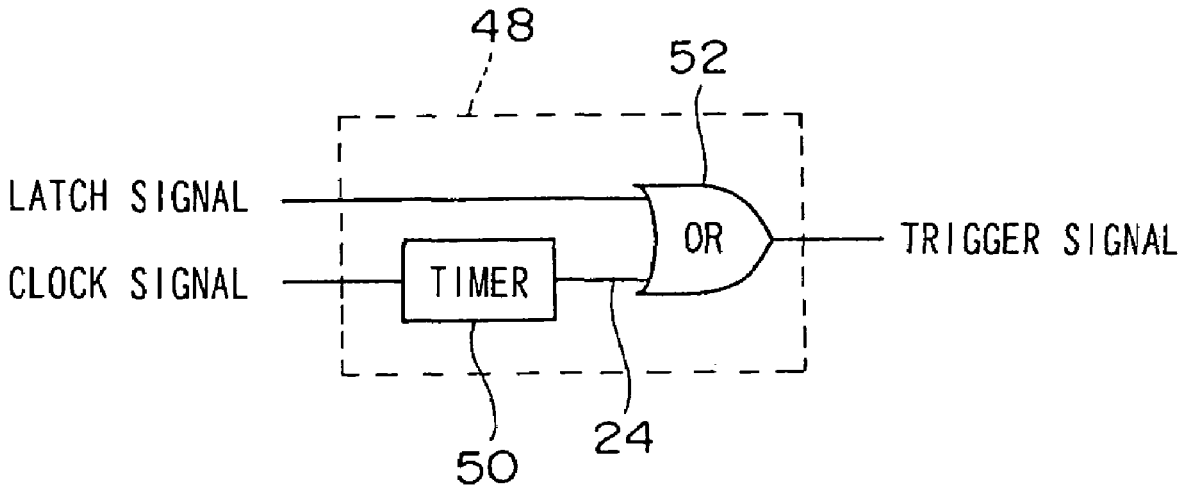
FIG. 11 is a block diagram showing yet another example of the configuration of the trigger signal generation section.

The trigger signal generation section 48 may be constituted as shown in either FIG. 10 or FIG. 11. When the trigger signal generation section 48 is constituted as shown in FIG. 10, only a latch signal is input into the timer 50 and the OR circuit 52, and the OR circuit 52 performs an OR operation between the delay signal 24 emanating from the timer 50 and the latch signal and outputs the operation result as a trigger signal. When the trigger signal generation section 48 is constituted as shown in FIG. 11, a latch signal is input into only the OR circuit 52, the OR circuit 52 performs an OR operation between a delay signal 24 emanating from the timer 50 and the latch signal and outputs the operation result as a trigger signal.

Figure 8:
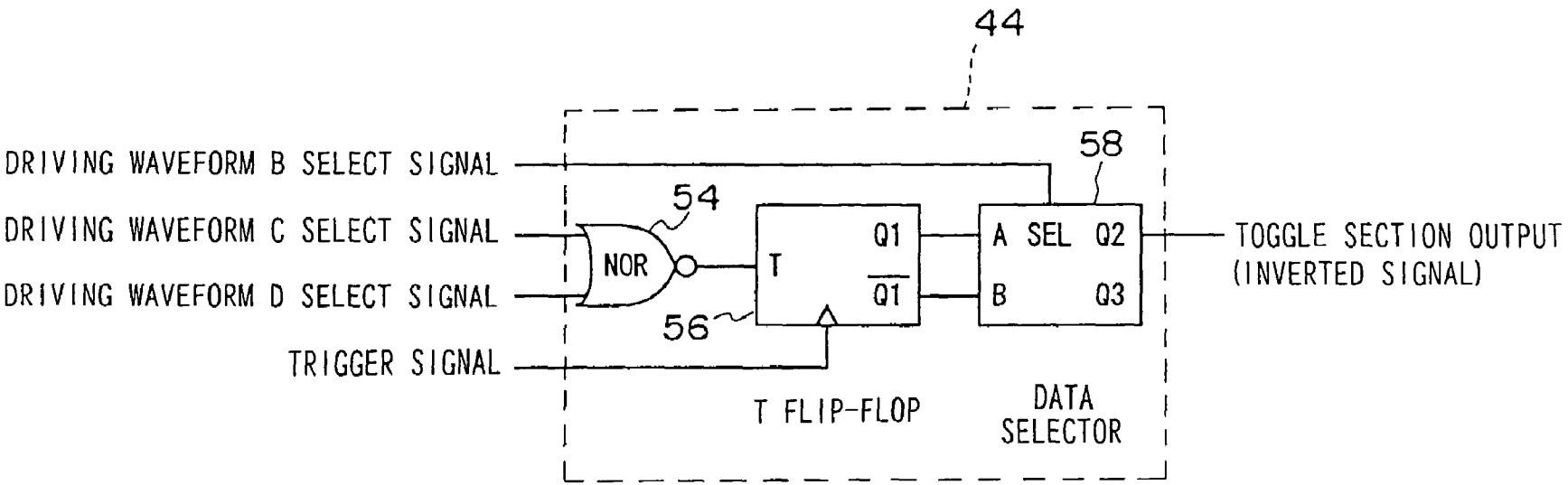
FIG. 8 is a block diagram showing a configuration of a toggle section.

As shown in FIG. 8, the toggle section 44 is constituted by a NOR circuit 54, a T flip-flop 56, and a data selector 58.

The driving waveform C select signal 20C and the driving waveform D select signal 20D are input into the NOR circuit 54. The NOR circuit 54 performs a NOR operation between the signals 20C and 20D, and outputs an operation result to the T flip-flop 56.

An output signal from the NOR circuit 54 is input into a T input terminal of the T flip-flop 56, and a trigger signal is input into a clock terminal thereof. While a high-level signal is being input into the T input terminal, the T flip-flop 56 performs an edge trigger operation in response to a trigger signal. Specifically, when an output signal from the NOR circuit 54 is at a high level, that is, the driving waveform C select signal 20C and the driving waveform D select signal 20D are both at low level, whenever a trigger signal is input into the T flip-flop 56, the T flip-flop 56 inverts a present value, i.e., an output of a Q1 output terminal. Alternatively, a /Q1 output terminal of the T flip-flop 56 inverts the output of the Q1 output terminal and outputs the inverted signal.

When the output signal from the NOR circuit 54 is at a low level, that is, when neither the driving waveform C select signal 20C nor the driving waveform D select signal 20D are at a low level, even when a trigger signal is input into the T flip-flop 56, the T flip-flop 56 does not invert the present value but maintains the outputs of the Q1 output terminal and the /Q1 output terminal.

The data selector 58 includes an A input terminal, a B input terminal, an SEL input terminal, a Q2 output terminal, and a Q3 output terminal. An output signal from the Q1 output terminal of the T flip-flop 56 is input into the A input terminal. An output signal from the /Q1 output terminal of the T flip-flop 56 is input into the B input terminal. The driving waveform B select signal 20B is input into the SEL input terminal.

When a low-level signal is input into the SEL input terminal, that is, when the driving waveform B select signal 20B is "0", the data selector 58 outputs from the Q2 output terminal the signal that has been input into the A input terminal, and outputs from the Q3 output terminal the signal that has been input into the B input terminal. On the other hand, when the high-level signal is input into the SEL input terminal, that is, when the driving waveform B select signal 20B is "1", then the data selector 58 outputs from the Q3 output terminal the signal which has been input into the A input terminal, and outputs from the Q2 output terminal the signal which has been input into the B input terminal.

Since the toggle section 44 is constituted as described above, if the driving waveform C select signal 20C and the driving waveform D select signal 20D are both "0", and the driving waveform B select signal 20B is also "0", then the output of the toggle section 44 is at a high level in the first half T1 of the period into which the one driving cycle T is divided, and the driving voltage waveform A is selected as the driving voltage waveform for discharging the ink droplets. When on the other hand the driving waveform C select signal 20C and the driving waveform D select signal 20D are both "0", and the driving waveform B select signal 20B is "1", then the output of the toggle section 44 is at high level during the second half T2 of the period into which the one driving cycle T is divided, and the driving voltage waveform B is selected as the driving voltage waveform for discharging the ink droplets.

When the driving waveform C select signal 20C is "1", the driving voltage waveform C is selected. When the driving waveform D select signal 20D is "1", the driving voltage waveform D is selected.

The level shifter 46 shifts the levels of the inverted signal 22 from the toggle section 44, and of the driving waveform C select signal 20C and the driving waveform D select signal 20D from the latch circuit 42, and outputs the level-shifted signals 22, 20C, and 20D to the switches $\mathbf{37}_{1a}$, $\mathbf{37}_{1b}$, and $\mathbf{37}_{1c}$, respectively.

It should be noted that the latch circuit 42 corresponds to a latch section according to the invention, the toggle section 44 corresponds to an inverted signal generation section according to the invention, and the trigger signal generation section 48 corresponds to a trigger signal generation section according to the invention.

Figure 9:
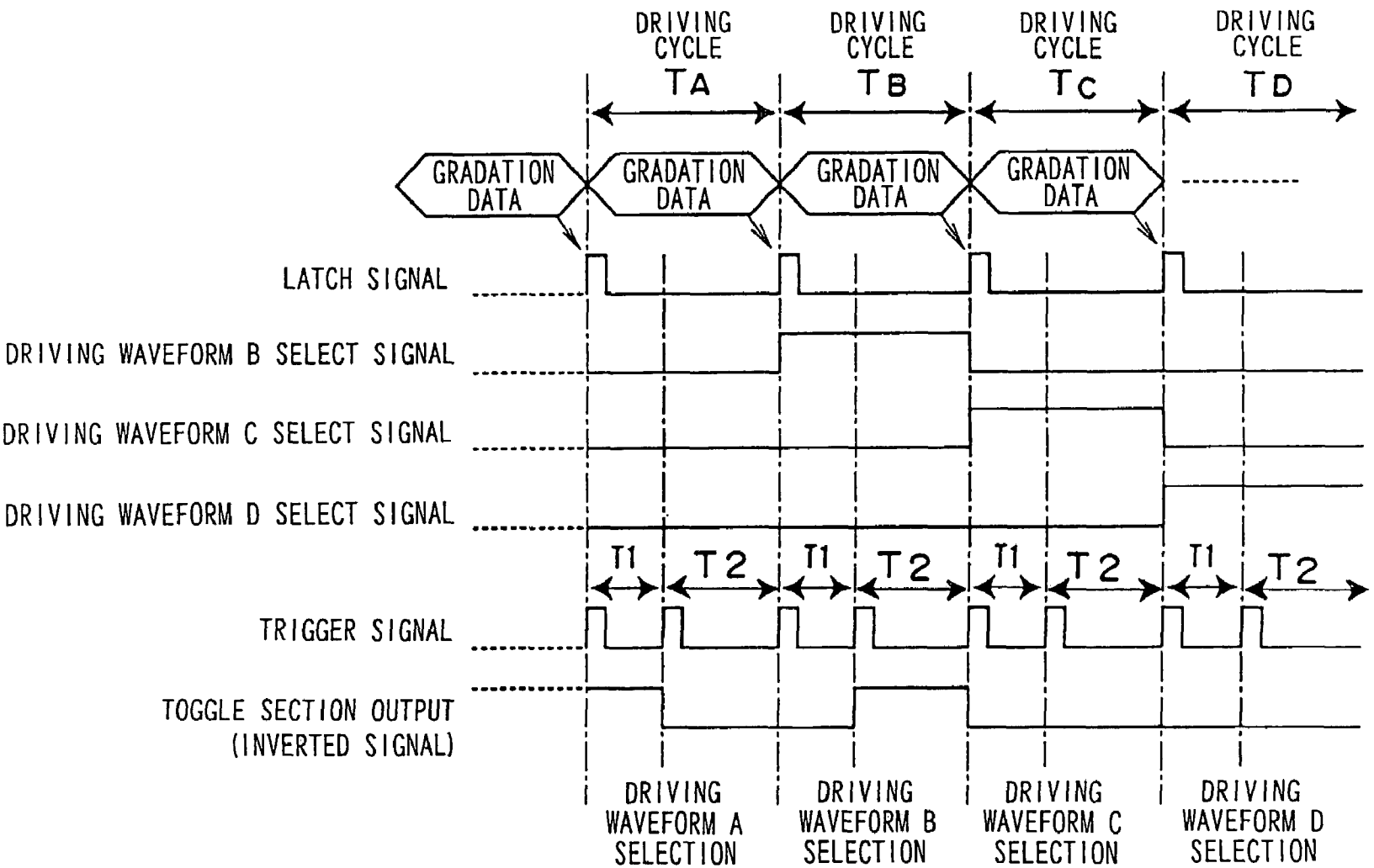
FIG. 9 is a timing chart showing timings of various signals.

Functions in this embodiment will next be described with reference to the time chart of FIG. 9. In this embodiment, as shown in FIG. 9, an instance will be described of selecting the driving waveforms in the order of the driving voltage waveform A, the driving voltage waveform B, the driving voltage waveform C, and the driving voltage waveform D.

For example, in response to a control indication signal CMC supplied from the exterior, the control section 31 outputs a drive motor driving indication signal SC1 for moving the inkjet recording head 1, and a drive motor driving indication signal SC2 for rotating the feed roller 14.

Further, based on print data DP, including gradation information supplied from the exterior, the control section 31 determines which of the predetermined driving voltage waveforms generated by the three waveform generation circuits 35*a*, 35*b*, and 35*c* is or not to be supplied to the four actuators $\mathbf{7}_1$, $\mathbf{7}_2$, $\mathbf{7}_3$, and $\mathbf{7}_4$. The control section 31 also transmits to the waveform select circuit 36 the waveform select signal as serial data for switching ON or OFF the switches $\mathbf{37}_{1a}$ to $\mathbf{37}_{4c}$, and outputs the latch signal to the latch circuit 42.

When for each main scan it is supplied from the exterior with a print start indication CMP, the control section 31 further supplies to the driving waveform generation section 33 a discharge start indication signal indicating the necessary number of times of discharge. As a result, for each driving cycle T, the driving voltage waveforms A and B, as shown in FIG. 5A, are output from the waveform generation circuit 35*a*, the driving voltage waveform C, as shown in FIG. 5B, is output from the waveform generation circuit 35*b*, and the driving voltage waveform D, as shown in FIG. 5C, is output from the waveform generation circuit 35*c*.

An instance of selectively supplying a driving waveform to actuator $\mathbf{7}_1$ will be described below, but the same procedure would also apply in the case of actuators $\mathbf{7}_2$, $\mathbf{7}_3$, and $\mathbf{7}_4$.

As shown in FIG. 9, in a first driving cycle $T_A$, when a latch signal is input into the latch circuit 42 synchronously with a clock signal, the latch circuit 42 latches gradation data stored in the shift register 40 which has been output by the control section 31 in a driving cycle immediately before the first driving cycle $T_A$, and the latch circuit 42 outputs the gradation data latched. In this context "gradation data" means the waveform select signal composed of the driving waveform B select signal 20B, the driving waveform C select signal 20C, and the driving waveform D select signal 20D. In the driving cycle $T_A$, the driving voltage waveform A is selected. Because of this, as shown in FIG. 9, the driving waveform B select signal 20B, the driving waveform C select signal 20C, and the driving waveform D select signal 20D are all at a low level. In other words, the latch circuit 42 latches the waveform select data "000" on the basis of the gradation "0".

When the latch signal is input into the trigger signal generation section 48, a trigger signal is generated and input into the toggle section 44. Since the driving waveform C select signal 20C and the driving waveform D select signal 20D are both at a low level, the high-level signal is input into the T input terminal of the T flip-flop 56 in the toggle section 44. In addition, the T flip-flop 56 performs an edge trigger operation, and the output of the Q1 output terminal is confirmed to be at a high level. Further, since the driving waveform B select signal 20B is at a low level, the data selector 58 selects the output of the Q1 output terminal of the T flip-flop 56 as the toggle section output, and the high-level signal is output as shown in FIG. 9.

Accordingly, switch $\mathbf{37}_{1a}$ is turned on, and switches $\mathbf{37}_{1b}$ and $\mathbf{37}_{1c}$, are both turned off, and the driving voltage waveform A is accordingly selected and supplied to the actuator $\mathbf{7}_1$.

When the trigger signal is again input into the T flip-flop 56 from the start of the driving cycle $T_A$ after the passage of the period T1, the output of the Q1 output terminal is inverted and the output of the toggle section 44 is reduced to a low level as shown in FIG. 9. As a result, in the remaining period T2, the switch $\mathbf{37}_{1a}$ is turned off, and no driving waveform is supplied to actuator $\mathbf{7}_1$.

In a next driving cycle $T_B$, the driving voltage waveform B is selected. Therefore, as shown in FIG. 9, the driving waveform B select signal 20B is at a high level, and the driving waveform C select signal 20C and the driving waveform D select signal 20D are both at a low level. In other words, the latch circuit 42 latches the waveform select data "100" on the basis of the gradation "1".

When the trigger signal is input into the toggle section 44 at the start of the driving cycle $T_B$, because the driving waveform C select signal 20C and the driving waveform D select signal 20D are both at a low level, the T flip-flop 56 in the toggle section 44 again performs an edge trigger operation. Further, since the driving waveform B select signal 20B is at a high level, the data selector 58 selects as the toggle section output the output of the /Q1 output terminal of the T flip-flop 56. As a result, a low-level signal is output, as is shown in FIG. 9.

Accordingly, the switches $\mathbf{37}_{1a}$, $\mathbf{37}_{1b}$, and $\mathbf{37}_{1c}$ are all turned off, and no driving waveform is supplied to actuator $\mathbf{7}_1$.

When, from the start of the driving cycle $T_B$ after the passage of the end of the period T1, the trigger signal is again input into the T flip-flop 56, the output of the Q1 output terminal is inverted. In addition, as shown in FIG. 9, the output of the toggle section 44 returns to a high level. As a result, within the remaining period T2, the switch $\mathbf{37}_{1a}$ is turned on, and the driving voltage waveform B is selected and supplied to actuator $\mathbf{7}_1$.

In the next driving cycle $T_C$, since the driving voltage waveform C is selected, as shown in FIG. 9, the driving waveform C select signal 20C is at a high level, and the driving waveform B select signal 20B and the driving waveform D select signal 20D are both at a low level. In other words, the latch circuit 42 latches the waveform select data "010" based on the gradation "2".

When the trigger signal is input into the toggle section 44 at the start of the driving cycle $T_C$, because neither the driving waveform C select signal 20C nor the driving waveform D select signal 20D are at a low level, the T flip-flop 56 in the toggle section 44 does not perform an edge trigger operation. Further, since the driving waveform B select signal 20B is at a low level, the data selector 58 selects as the toggle section output the output of the Q1 output terminal of the T flip-flop 56. As a result, a low-level signal is output, as is shown in FIG. 9.

Accordingly, switch $\mathbf{37}_{1b}$ is turned on and switches $\mathbf{37}_{1a}$ and $\mathbf{37}_{1c}$ are both turned off; and the driving voltage waveform C is selected and supplied to actuator $\mathbf{7}_1$.

In the next driving cycle $T_D$, because the driving voltage waveform D is selected, as shown in FIG. 9, the driving waveform D select signal 20D is at a high level, and the driving waveform B select signal 20B and the driving waveform C select signal 20C are both at a low level. In other words, the latch circuit 42 latches the waveform select data "001", on the basis of the gradation "3".

When the trigger signal is input into the toggle section 44 at the start of the driving cycle $T_D$, because neither the driving waveform C select signal 20C nor the driving waveform D select signal 20D are at a low level, the T flip-flop 56 in the toggle section 44 does not perform an edge trigger operation. Further, since the driving waveform B select signal 20B is at a low level, the data selector 58 selects as the toggle section output the output of the Q1 output terminal of the T flip-flop 56. As a result, a low-level signal is output, as is shown in FIG. 9.

Accordingly, switch $\mathbf{37}_{1c}$ is turned on and switches $\mathbf{37}_{1a}$ and $\mathbf{37}_{1b}$ are both turned off; and the driving voltage waveform D is selected and supplied to actuator $\mathbf{7}_1$.

Thus, in this embodiment, the toggle section 44 is provided between the latch circuit 42 and the level shifter 46, and in response to an inverted signal from the toggle section 44, one of the driving voltage waveform A and the driving voltage waveform B generated by the waveform generation circuit 35*a* is exclusively selected, and the waveform selected can be supplied to actuator 7. Therefore, even when a waveform generation circuit that outputs plural driving voltage waveforms within one driving cycle and a waveform generation circuit that outputs only one driving voltage waveform within the one driving cycle are combined, it is unnecessary to transfer the waveform select signal from the control section 31 to the waveform select circuit 36 in both the periods T1 and T2, and it is sufficient to transfer the waveform select signal from the control section 31 to the waveform select circuit 36 only once within each driving cycle.

It is, thus, possible to prevent gradation data from becoming redundant, and in consequence to simplify image processing control. Further, since the time required for the shift register 40 to transfer the waveform select signal can be reduced, high-speed printing becomes possible.

Moreover, when the number of actuators 7 increases, on occasions a shift register cannot transfer the necessary waveform within one driving cycle. As a result, it is necessary to provide plural shift registers 40. However, in this embodiment, the number of shift registers 40 can be reduced, since the transfer time required for the gradation data can be reduced as has been described above.

In this manner, the number of signal lines between the control section 31 and the waveform select circuit 36 can be reduced, thereby making it possible to reduce the size of both the switching section 34 and the control section 31, and to simplify the operations of both sections.

A diminution in the redundancy of gradation data and a reduction in transfer time mean in practice that longer gradation data can be transferred. Accordingly, the number of gradations for each actuator can be increased, and image quality can be enhanced. Alternatively, instead of increasing the number of gradations, the number of actuators can be increased, and high-speed printing becomes achievable.

From different viewpoints also, the diminution in the redundancy of gradation data and the reduction in transfer time mean in practice that the transfer rate of gradation data can be reduced even with a printer that achieves high speed printing. Therefore, the switching section 34, for example, can be constituted by using a thin film transistor or the like on a glass substrate, an operation which is considered to require a lower rate of speed than a transistor on a silicon substrate. Thus, an operational area can be increased in size. As a result, in comparison with a case where the switching section 34 is constituted by using a silicon substrate, it is possible not only to cope with an increase in the number of actuators, but also to reduce the number of switching sections 34 for each inkjet recording head, and thereby achieve reductions in costs.

In this embodiment, the waveform select circuit 36 in the driving device 10 is constituted to provide the toggle section 44 in front of the level shifter 46. In consequence to this, as compared with a configuration in which the toggle section 44 is provided at the rear of the level shifter 46, the driving device 10 can operate at a lower voltage, and the area occupied by the switching section 34 can be reduced even further.

Furthermore, a trigger signal is generated on the basis of at least one of the latch signal input to the latch circuit 42 and the clock signal input to the shift register 40, and a trigger signal can thus be generated with a simple configuration using the timer 50 and the OR circuit 52.

As described above, according to this embodiment, the waveform select signal is a serial signal composed by plural driving waveform select signals provided in accordance with the number of first and second waveform generation sections, and the driving waveform supply section is provided to cope with each of the driving waveform select signals. Namely, the driving waveform supply section can be constituted to include plural switches for turning on or off the supply to the vibration generation section of driving waveforms in accordance with the corresponding driving waveform select signals, a shift register that converts a serial signal into a parallel signal, a latch section that latches the parallel signal on the basis of a latch signal, and an inverted signal generation section constituted so that if the driving waveform selected is generated by the first waveform generation section, an inverted signal, turned on during a divided period in which the driving waveform is generated, and turned off in the other period, is generated on the basis of a parallel signal latched by the latch section, and so that instead of a driving waveform select signal related to the first waveform generation section an inverted signal is output to the corresponding switch.

The waveform select signal can be constituted by a serial signal composed of plural driving waveform select signals provided to relate to the number of first and second waveform generation sections.

In summary, the driving waveform supply section can be constituted to include plural switches, a shift register, a latch section, and an inverted signal generation section.

The switch is provided to relate to each of plural driving waveform select signals, so as to turn on and off the supply to the vibration generation section of a driving waveform in accordance with a corresponding driving waveform select signal.

The shift register converts the serial signal into a parallel signal. The latch section latches the parallel signal output by the shift register on the basis of the latch signal. The latch signal is output by, for example, the control section.

The first waveform generation section generates plural driving waveforms, but because the driving waveform select signals are provided in accordance with the number of waveform generation sections, only one driving waveform select signal is allocated to the plural driving waveforms generated by the first waveform generation section.

In view of this, the inverted signal generation section is constituted so that, when a driving waveform selected is a driving waveform generated by the first waveform generation section, an inverted signal is generated on the basis of the parallel signal latched by the latch section, and is turned on during the divided period within which the driving waveform is generated, and turned off during the other period. The inverted signal generated instead of the driving waveform select signal related to the first waveform generation section is output to the corresponding switch. It is thereby possible to select more driving waveforms than driving waveform select signals.

It is further preferable that the waveform select circuit further includes a level shifter that shifts levels of parallel signals output to plural switches, and so that the inverted signal generation section is provided in front of the level shifter. In other words, the inverted signal generation section is preferably provided between the level shifter and the latch section.

The waveform select circuit can be constituted to include a trigger signal generation section that generates a trigger signal which determines a timing for inversion of the inverted signal on the basis of at least one of the latch signal and the clock signal supplied to the shift register.

The trigger signal generation section can be constituted to include a timer that generates a delay signal on the basis of, for example, at least one of the clock signal and the latch signal, and an OR circuit that performs an OR operation between this delay signal and the latch signal and that outputs an operation result.

The inverted signal generation section can be constituted to include a NOR signal generation section that generates a NOR signal, turned on when the driving waveform select signals relating to the second waveform generation section are all turned off, and otherwise turned off; a T flip-flop including a T input terminal for inputting the NOR signal, a clock input terminal for inputting the trigger signal, an output terminal for outputting an output signal generated on the basis of the input of the T input terminal and that of the clock input terminal, and an inverted output terminal for outputting an output inverted signal inverted from an output signal; and a select section that selects and outputs one of the output signal and the output inverted signal on the basis of driving waveform select signals emanating from the first waveform generation section.

An embodiment of the invention has been described above. However, the invention is not in any sense limited to such an embodiment. In the embodiment, for example, only an instance of performing gradation recording using one color has been described. However, by providing an inkjet recording head with nozzles that discharge ink droplets in multiple colors, color gradation recording can be realized.

Moreover, in the embodiment, an instance has been described of supplying DSWN data for selecting the driving waveform from the control section 31 to the switching section 34. However, as long as a switch changeover can be achieved, the invention is not limited to such an instance.

Further, an instance has been described in which the control section 31 supplies a discharge start indication signal to the driving waveform generation section 33. However, the invention is not limited to such an instance. A position detection section, such as a position encoder that detects a position of the inkjet recording head 1, may be provided so as to detect an inkjet recording head 1 that passes through a predetermined pixel position, and in response to the detection signal of the position detection section to supply a discharge start indication to the driving waveform generation section 33.

Furthermore, in the embodiment, an instance has been described in which the control section 31 selects a driving voltage waveform signal during each scanning process and the like. However, the invention is not limited to such an instance. The driving voltage waveform signal may also be selected on the basis of external control. Furthermore, while in the embodiment three waveform generation circuits 35*a*, 35*b*, and 35*c* are provided in the driving waveform generation section 33, the number of waveform generation circuits provided may also be two, or four or more.

While in the embodiment an instance of dividing the driving cycle T into two periods has been described, the driving cycle T may also be divided into three or more periods. In so doing, the number of gradations that can be realized during the course of one driving cycle can be increased.

In the embodiment, an instance has also been described in which the waveform generation circuit generates the driving voltage waveform. However, as long as the internal voltage of the pressure generation chamber can be changed and ink droplets can accordingly be discharged from the nozzle, the waveform generated by the waveform generation circuit is not limited to a voltage waveform but may also be a current waveform or another type of waveform.

A second embodiment of the present invention will next be described. In this embodiment, a modification of the toggle section will be described. The same sections as those in the first embodiment are denoted by the same reference symbols, respectively, and will accordingly not be described in detail.

Figure 12:
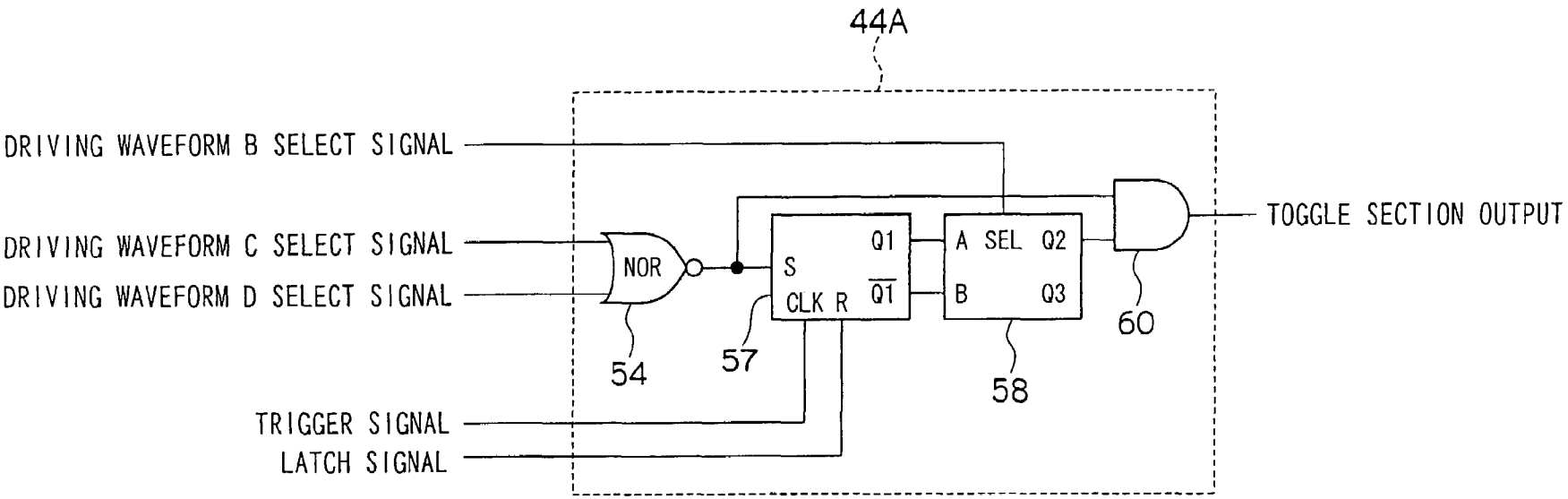
FIG. 12 is a block diagram showing another example of the configuration of the toggle section.

FIG. 12 is a block diagram showing a configuration of a toggle section 44A in the embodiment. As shown in FIG. 12, the toggle section 44A is constituted by a NOR circuit 54, an SR flip-flop 57, a data selector 58, and an AND circuit 60.

A driving waveform C select signal 20C and a driving waveform D select signal 20D are input into the NOR circuit 54. The NOR circuit 54 performs a NOR operation between the signals 20C and 20D, and outputs an operation result to the SR flip-flop 57.

An output signal from the NOR circuit 54 is input to an S (set) input terminal of the SR flip-flop 57, a trigger signal is input into a CLK (clock) terminal thereof, and a latch signal is input into an R (reset) input terminal thereof.

The AND circuit 60 performs an AND operation between the output signal of the NOR circuit 54 and an output signal of the data selector 58, and outputs an operation result.

As shown in FIG. 9, a latch signal is input for each driving cycle. Therefore, by inputting the latch signal into the R input terminal of the SR flip-flop 57, the T flip-flop 56 shown in FIG. 8 can be replaced by an SR flip-flop 57 and the toggle section 44A can operate in a similar manner to the toggle section 44 shown in FIG. 8.

The AND circuit 60 may be omitted. However, by constituting the toggle section 44A to provide, as the toggle section output, a result of the AND operation between the output of the Q2 output terminal of the data selector 58 and the output of the NOR circuit 54, it is possible to prevent malfunctioning of the toggle section 44A with a greater degree of certitude.

Figure 13:
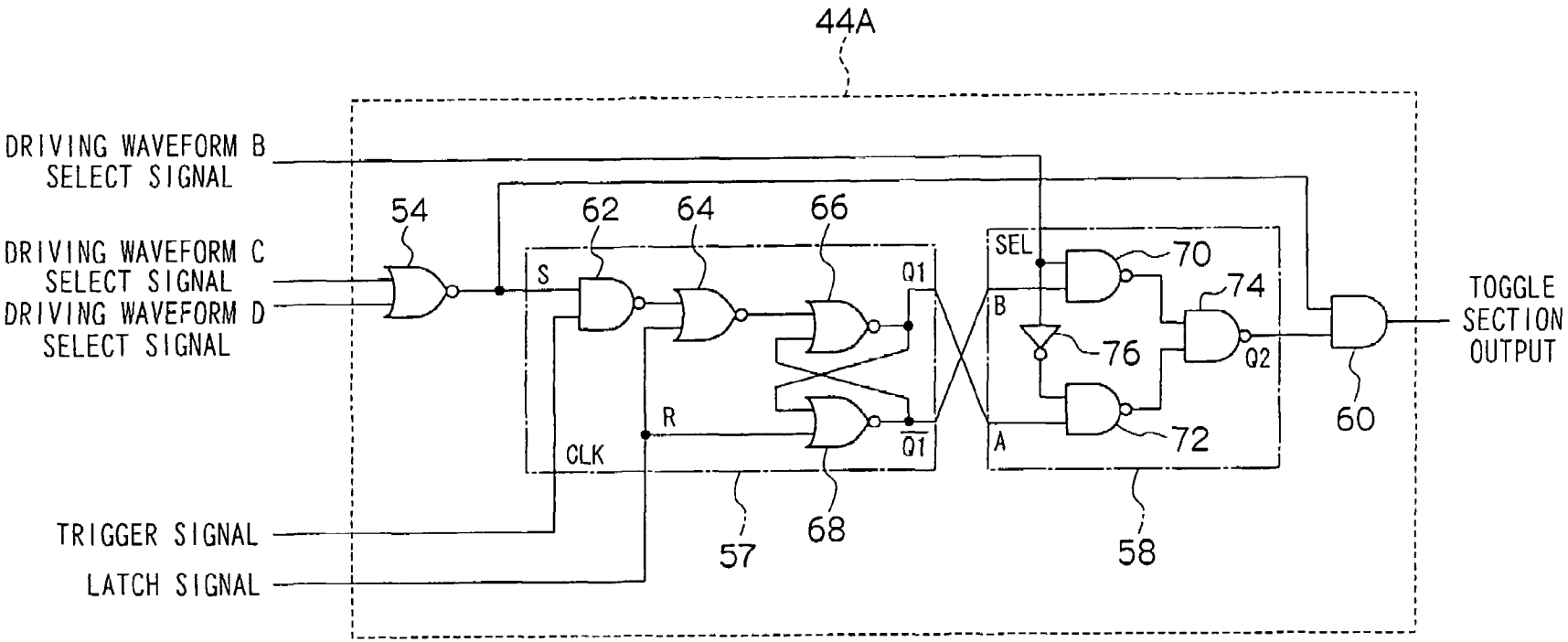
FIG. 13 is a block diagram showing in detail yet another example of the configuration of the toggle section.

FIG. 13 is a block diagram of an example of detailed circuit configuration of the SR flip-flop 57 and the data selector 58 in the toggle section 44A.

As shown in FIG. 13, the SR flip-flop 57 is constituted by a NAND circuit 62, and NOR circuits 64, 66, and 68.

In this embodiment, a synchronization flip-flop is used so as to simplify the flip-flop. In addition, the SR flip-flop 57 is a modification of the synchronization SR flip-flop. When a high-level signal is input into the R input terminal of the SR flip-flop 57, the output of the Q1 output terminal is confirmed to be at a high-level signal, and the output of the /Q1 output terminal is confirmed to be at a low-level signal, irrespectively of inputs to the S input terminal and the CLK input terminal.

The data selector 58 is constituted by NAND circuits 70, 72, and 74, and a NOT circuit 76. Since the Q3 output terminal is not used, the data selector 58 has a logical configuration of two inputs and one output.

If the toggle section 44A is constituted as described above, the trigger signal generation section 48 is constituted to generate only one trigger signal at a time during the course of one driving cycle T, at which period T1 changes to period T2; or as in the case of the trigger signal shown in the timing chart of FIG. 9, to generate during the course of one driving cycle T a trigger signal at the same time as the latch signal and at the same time as the period T1 changes to period T2; or to generate a trigger signal so that a pulse width of the trigger signal generated at the same time as the latch signal is smaller than that of the latch signal. When such a trigger signal is input into the CLK input terminal of the SR flip-flop 57, the toggle section 44A can operate in a similar fashion to the toggle section 44 described in the first embodiment.

Thus, the inverted signal generation section can be constituted to include a NOR signal generation section that generates a NOR signal, turned on when the driving waveform select signals related to the second waveform generation section are all turned off and otherwise turned off; an SR flip-flop including an S input terminal for inputting the NOR signal, a clock input terminal for inputting a trigger signal, an R input terminal for inputting a latch signal, an output terminal for outputting an output signal generated on the basis of inputs of the S input terminal, the R input terminal, and the clock input terminal, and an inverted output terminal for outputting the output inverted signal inverted from the output signal; and a select section that selects and outputs one of the output signal and the output inverted signal on the basis of the driving waveform select signal emanating from the first waveform generation section.

The inverted signal generation section may also be constituted to further include an AND circuit that performs an AND operation between the NOR signal and the driving waveform select signal emanating from the first waveform generation section, and that outputs an operation result as an inverted signal.

In the invention, the relationship between the configuration of the inkjet recording head and that of the driving circuit may be arbitrarily set. The inkjet recording head may be constituted to include the driving circuit described above.

Further, as a specific embodiment, an inkjet printer may be constituted to include the driving circuit described above.

As described above, with a configuration in which plural gradations are acquired by virtue of a waveform generation circuit that outputs multiple driving voltage waveforms within the course of one driving cycle and a waveform generation circuit that outputs only one driving voltage waveform during the course of one driving cycle, the invention can demonstrate superior effects insofar that it suffices to transfer waveform select data on the basis of gradation data only once within each driving cycle.

What is claimed is:

1. A driving circuit for an inkjet recording head, the inkjet recording head having: a plurality of pressure generation chambers filled with an ink; a nozzle which is provided in each of the pressure generation chambers, and from which ink is discharged; and a vibration generation section which is provided to relate to each of the pressure generation chambers, and the role of which vibration generation section is to cause a pressure change in each of the pressure generation chambers, the driving circuit comprising:

a driving waveform generation section that generates a first group of driving waveforms including at least a first driving waveform and a second driving waveform that are different from each other, according to sizes of droplets of the ink, and a second group of driving waveforms including a third waveform which is generated once every driving cycle;

a control section that during each driving cycle outputs, on the basis of a recording data, a waveform select signal for selecting a driving waveform, from among the plurality of driving waveforms including the first and second driving waveforms to be supplied to the vibration generation section; and a driving waveform supply section that includes a trigger signal generation section which outputs a trigger signal when a prescribed time period corresponding to the first driving waveform or the second driving waveform has elapsed from the beginning of each driving cycle, and that selects, for each divided period into which the driving cycle is divided, either the first or the second driving waveform on the basis of the trigger signal and the waveform select signal, and supplies the driving waveform selected to the vibration generation section, wherein the driving waveform generation section includes a first driving waveform generation section that generates the first group of driving waveforms and a second driving waveform generation section that generates the second group of driving waveforms, and wherein the waveform select signal is at least one serial signal composed of a plurality of driving waveform select signals provided in accordance with the number of first and second waveform generation sections, and the driving waveform supply section includes:

a plurality of switches that is provided to respectively relate to the plurality of driving waveform select signals, and that, in accordance with the respective plurality of driving waveform select signals, turns on and off a supply of the driving waveform to the vibration generation section;

a shift register that converts the at least one serial signal into at least one parallel signal;

a latch section that latches the at least one parallel signal on the basis of a latch signal; and an inverted signal generation section that, when one of the first through third driving waveforms selected is a driving waveform generated by the first waveform generation section, generates an inverted signal which, on the basis of the at least one parallel signal latched by the latch section, is turned on during divided periods in which the driving waveform is generated, and which is turned off during other periods, and that outputs, instead of one of the plurality of driving waveform select signals related to the first waveform generation section, an inverted signal to at least one of the plurality of switches.

2. The driving circuit for an inkjet recording head according to claim 1, wherein the control section outputs a waveform select signal once during each driving cycle.

3. The driving circuit for an inkjet recording head according to claim 1, wherein at least one of the first and second driving waveforms generated by the first waveform generation section includes a waveform that ensures that ink is not discharged.

4. The driving circuit for an inkjet recording head according to claim 1, further comprising a level shifter that shifts a level of the at least one parallel signal output to the plurality of switches, wherein the inverted signal generation section is provided in front of the level shifter.

5. The driving circuit for an inkjet recording head according to claim 1, wherein the trigger signal generation section, on the basis of at least one of the latch signal and a clock signal supplied to the shift register, generates a trigger signal for determining a timing for inversion of the signal to be inverted.

6. The driving circuit for an inkjet recording head according to claim 5, wherein the trigger signal is provided by logical OR of the latch signal and a signal delayed for a predetermined time after the latch signal.

7. The driving circuit for an inkjet recording head according to claim 5, wherein the trigger signal is provided by logical OR of the latch signal and a signal delayed for a predetermined time after the clock signal.

8. The driving circuit for an inkjet recording head according to claim 5, wherein the inverted signal generation section includes:

a NOR signal generation section that generates a NOR signal which is turned on when the driving waveform select signals related to the second waveform generation section are all turned off, and which is otherwise turned off;

a logical signal generation section that outputs an output signal generated on the basis of inputs of a NOR signal and a trigger signal, and that outputs an output inverted signal inverted from the output signal; and a select section that, on the basis of a driving waveform select signal related to the first waveform generation section, selects and outputs one out of an output signal and an output inverted signal, both of which have been generated by the logical signal generation section.

9. The driving circuit for an inkjet recording head according to claim 8, wherein the logical signal generation section is constituted by a T flip-flop, the T flip-flop including: a T input terminal for inputting a NOR signal; a clock input terminal for inputting a trigger signal; an output terminal for outputting an output signal generated on the basis of an input from the T input terminal and an input from the clock input terminal; and an inverted output terminal for outputting an output inverted signal inverted from the output signal.

10. The driving circuit for an inkjet recording head according to claim 8, wherein the logical signal generation section is constituted by an SR flip-flop, the SR flip-flop including: an S input terminal for inputting a NOR signal; a clock input terminal for inputting a trigger signal; an R input terminal for inputting a latch signal; an output terminal for outputting an output signal generated on the basis of inputs from the S input terminal, the R input terminal, and the clock input terminal; and an inverted output terminal for outputting an output inverted signal inverted from an output signal.

11. The driving circuit for an inkjet recording head according to claim 5, wherein the inverted signal generation section includes:

a NOR signal generation section that generates a NOR signal which is turned on when the driving waveform select signals related to the second waveform generation section are all turned off, and which is otherwise turned off;

a T flip-flop that includes: a T input terminal for inputting a NOR signal, a clock input terminal for inputting a trigger signal, an output terminal for outputting an output signal generated on the basis of an input from the T input terminal and an input from the clock input terminal, and an inverted output terminal for outputting an output inverted signal inverted from an output signal; and a select section that, on the basis of a driving waveform select signal related to the first waveform generation section, selects and outputs one out of an output signal and an output inverted signal.

12. The driving circuit for an inkjet recording head according to claim 11, wherein the inverted signal generation section includes an AND circuit which performs an AND operation of a NOR signal and a driving waveform select signal relating to the first waveform generation section, and which outputs as an operation result an inverted signal.

13. The driving circuit for an inkjet recording head according to claim 5, wherein the inverted signal generation section includes:

a NOR signal generation section that generates a NOR signal which is turned on when the driving waveform select signals related to the second waveform generation section are all turned off, and which is otherwise turned off;

an SR flip-flop including: an S input terminal for inputting a NOR signal, a clock input terminal for inputting a trigger signal; an R input terminal for inputting a latch signal; an output terminal for outputting an output signal generated on the basis of inputs from the S input terminal, the R input terminal, and the clock input terminal; and an inverted output terminal for outputting an output inverted signal inverted from an output signal; and a select section that, on the basis of a driving waveform select signal related to the first waveform generation section, selects and outputs one out of the output signal and the output inverted signal.

14. An inkjet recording head, having:

a plurality of pressure generation chambers filled with an ink;

a nozzle which is provided in each of the pressure generation chambers, and from which ink is discharged;

a vibration generation section which is provided to relate to each of the pressure generation chambers, and the role of which vibration generation section is to causes a pressure change in each of the pressure generation chambers, and;

a driving circuit for the inkjet recording head, the driving circuit comprising:

a driving waveform generation section that generates a first group of driving waveforms including at least a first driving waveform and a second driving waveform that are different from each other, according to sizes of droplets of the ink, and a second group of driving waveforms including a third driving waveform which is generated once every driving cycle;

a control section that during each driving cycle outputs, on the basis of a recording data, a waveform select signal for selecting a driving waveform, from among the plurality of driving waveforms including the first and second driving waveforms to be supplied to the vibration generation section; and a driving waveform supply section that includes a trigger signal generation section which outputs a trigger signal when a prescribed time period corresponding to the first driving waveform or the second driving waveform has elapsed from the beginning of each driving cycle, and that selects, for each divided period into which the driving cycle is divided, either the first driving waveform or the second driving waveform on the basis of the trigger signal and the waveform select signal, and supplies the driving waveform selected to the vibration generation section, wherein the driving waveform generation section includes a first driving waveform generation section that generates the first group of driving waveforms and a second driving waveform generation section that generates the second group of driving waveforms, and wherein the waveform select signal is at least one serial signal composed of a plurality of driving waveform select signals provided in accordance with the number of first and second waveform generation sections, and the driving waveform supply section includes:

a plurality of switches that is provided to respectively relate to the plurality of driving waveform select signals, and that, in accordance with the respective plurality of driving waveform select signals, turns on and off a supply of the driving waveform to the vibration generation section;

a shift register that converts the at least one serial signal into at least one parallel signal;

a latch section that latches the at least one parallel signal on the basis of a latch signal; and an inverted signal generation section that, when one of the first through third driving waveforms selected is a driving waveform generated by the first waveform generation section, generates an inverted signal which, on the basis of the at least one parallel signal latched by the latch section, is turned on during divided periods in which the driving waveform is generated, and which is turned off during other periods, and that outputs, instead of one of the plurality of driving waveform select signals related to the first waveform generation section, an inverted signal to at least one of the plurality of switches.

15. An inkjet printer comprising an inkjet recording head, wherein the inkjet recording head comprises:

a plurality of pressure generation chambers filled with an ink;

a nozzle which is provided in each of the pressure generation chambers, and from which ink is discharged;

a vibration generation section which is provided to relate to each of the pressure generation chambers, and the role of which vibration generation section is to cause a pressure change in each of the pressure generation chambers, and a driving circuit for the inkjet recording head comprising:

a driving waveform generation section that generates a first group of driving waveforms including at least a first driving waveform and a second driving waveform that are different from each other, according to sizes of droplets of the ink, and a second group of driving waveforms including a third driving waveform which is generated once every driving cycle;

a control section that during each driving cycle outputs, on the basis of a recording data, a waveform select signal for selecting one driving waveform, from among the plurality of driving waveforms including the first and second driving waveforms to be supplied to the vibration generation section; and a driving waveform supply section that includes a trigger signal generation section which outputs a trigger signal when a prescribed time period corresponding to the first driving waveform or the second driving waveform has elapsed from the beginning of each driving cycle, and that selects, for each divided period into which the driving cycle is divided, either the first driving waveform or the second driving waveform on the basis of the trigger signal and the waveform select signal, and supplies the driving waveform selected to the vibration generation section, wherein the driving waveform generation section includes a first driving waveform generation section that generates the first group of driving waveforms and a second driving waveform generation section that generates the second group of driving waveforms, and wherein the waveform select signal is at least one serial signal composed of a plurality of driving waveform select signals provided in accordance with the number of first and second waveform generation sections, and the driving waveform supply section includes:

a plurality of switches that is provided to respectively relate to the plurality of driving waveform select signals, and that, in accordance with the respective plurality of driving waveform select signals, turns on and off a supply of the driving waveform to the vibration generation section;

a shift register that converts the at least one serial signal into at least one parallel signal;

a latch section that latches the at least one parallel signal on the basis of a latch signal; and an inverted signal generation section that, when one of the first through third driving waveforms selected is a driving waveform generated by the first waveform generation section, generates an inverted signal which, on the basis of the at least one parallel signal latched by the latch section, is turned on during divided periods in which the driving waveform is generated, and which is turned off during other periods, and that outputs, instead of one of the plurality of driving waveform select signals related to the first waveform generation section, an inverted signal to at least one of the plurality of switches.

* * * * *